US005196092A

United States Patent [19]

Stigberg

[11] Patent Number: 5,196,092

[45] Date of Patent: Mar. 23, 1993

[54] REINFORCEMENT OF COATED SURFACES OF LNP BELTS

[75] Inventor: Carl E. Stigberg, Schenectady, N.Y.

[73] Assignee: Albany International Corp., Albany, N.Y.

[21] Appl. No.: 766,437

[22] Filed: Sep. 25, 1991

[51] Int. Cl.[5] ..... D21F 3/02

[52] U.S. Cl. ..... 162/358.4; 162/901; 198/847; 428/252; 428/272

[58] Field of Search ..... 162/358, DIG. 1, 361, 162/358.4, 901; 428/252, 272; 198/847

[56] References Cited

U.S. PATENT DOCUMENTS

| | | | |
|---|---|---|---|
| 4,229,254 | 10/1980 | Gill | 162/358 |
| 4,238,287 | 12/1980 | Gill | 162/361 |
| 4,411,947 | 10/1983 | Heynhold | 198/847 |
| 4,564,551 | 1/1986 | Best | 162/DIG. 1 |
| 4,674,622 | 6/1987 | Utsunomiya et al. | 198/847 |

FOREIGN PATENT DOCUMENTS

| | | | |
|---|---|---|---|
| 3231039 | 3/1983 | Fed. Rep. of Germany | 162/358 |
| 8319684 | 10/1984 | Fed. Rep. of Germany | 162/358 |

*Primary Examiner*—Karen M. Hastings

*Attorney, Agent, or Firm*—Kane, Dalsimer, Sullivan, Kurucz, Levy, Eisele & Richard

[57] ABSTRACT

A belt for use on a long nip press for dewatering a fibrous web includes a base fabric, woven from machine-direction and cross-machine directions yarns and taking the form of an endless loop. The base fabric many be woven from monofilaments yarns of a synthetic polymeric resin in either a single- or a multi-layer weave. At least one side of the base fabric, namely, that side which will be on the inside of the belt in its endless loop form, and which slides over the arcuate pressure shoe component of the long nip press during its operation, is coated with a polymeric resin, such as polyurethane, to render it impervious to liquids, especially lubricating oil. The coating is reinforced with a flexible layer of reinforcing fiber which may take the form of a woven sheet or may be in single filament form in single or multiple layers thereof. When in single filament form, each layer includes filaments disposed adjacent and substantially parallel to one another. The reinforcing fiber may be of a synthetic polymeric resin or of metal. In either case, the reinforcement renders the coating less susceptible to cracking and to damage from foreign objects while the belt is in use on the long nip press.

9 Claims, 2 Drawing Sheets

REINFORCEMENT OF COATED SURFACES OF LNP BELTS

BACKGROUND OF THE INVENTION

1. Field of the Invention

The present invention relates to mechanisms for extracting water from a web of material, and more particularly from a fibrous web being processed into a paper product on a papermaking machine. Specifically, the present invention is an impermeable belt designed for use in conjunction with an long nip press on a papermaking machine.

2. Description of the Prior Art

During the papermaking process, a fibrous web is formed on a forming wire by depositing a fibrous slurry thereon. A large amount of water is drained from the slurry during this process, after which the newly formed web proceeds to a press section. The press section includes a series of press nips, in which the fibrous we is subjected to compressive forces designed to remove water therefrom. The web finally proceeds to a drying section which includes heated dryer drums around which the web is directed. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial, especially when a large amount of water needs to be removed from the web.

Traditionally, press sections have included a series of nips formed by pairs of adjacent cylindrical press rollers. Recently, the use of long press nips has been found to be advantageous over the use of nips formed by pairs of adjacent rollers. The longer the web can be subjected to pressure in the nip, the more water can be removed there, and, consequently, the less will remain to be removed through evaporation in the dryer section.

The present invention relates to long nip presses of the shoe type. In this variety of long nip press, the nip is formed between a cylindrical press roller and an arcuate pressure shoe. The latter has a cylindrically concave surface having a radius of curvature close to that of the cylindrical press roller. When roller and shoe are brought into close physical proximity, a nip is formed which can be five to ten times longer in the machine direction than one formed between two press rollers. This increases the so-called dwell time of the fibrous web in the long nip while maintaining the same level of pressure per square inch pressing force used in a two-roller press. The result of this new long nip technology has been a dramatic increase in dewatering of the fibrous web in the long nip when compared to conventional nips on paper machines.

A long nip press of the shoe type requires a special belt, such as that shown in Canadian Patent No. 1,188,556. This belt is designed to protect the press fabric supporting, carrying, and dewatering the fibrous web from the accelerated wear that would result from direct, sliding contact over the stationary pressure shoe. Such a belt must be made with a smooth impervious surface that rides, or slides over the stationary shoe on a lubricating film of oil. The belt moves through the nip at roughly the same speed as the press fabric, thereby subjecting the press fabric to minimal amounts of rubbing against stationary components.

Belts of the variety shown in Canadian Patent No. 1,188,556 are made by impregnating a woven base fabric, which takes the form of an endless loop, with a synthetic polymeric resin. Preferably, the resin forms a coating of some predetermined thickness on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

In practice, during the operation of the long nip press, the coating is subjected to considerable mechanical stress. As the belt takes the form of an endless loop, it is directed through the long press nip by several rollers, each of which serve to flex the belt, thereby subjecting the coating to a repeated stress that may ultimately lead to cracking. At the same time, contact with foreign objects may damage the coating during the normal operation of the belt on the papermachine.

The present invention provides a solution to these problems in the form of a surface reinforcement for the coated surfaces of long nip press belts.

SUMMARY OF THE INVENTION

The present invention is directed toward a belt for use on a long nip press for dewatering a fibrous web, and a method of making the belt.

With reference first to the structure of the belt of the invention, the belt comprises a base fabric which takes the form of an endless loop as a result of having been woven in endless form, or of having been flat woven and joined into endless form with a seam. The base fabric may be a woven fabric of single or multiple layers comprising monofilament yarns of a synthetic polymeric resin.

At least the inner surface of the base fabric is coated with a polymeric resin, which impregnates the fabric and renders it impervious to fluids, particularly to the oil used to lubricate the arcuate pressure shoe component of the long nip press.

In the present invention, the coating is reinforced with a flexible layer of reinforcing fiber material encapsulated therewithin.

The reinforcing fiber material comprises filaments, rather than staple fibers, and may be a woven sheet of such filaments, or one or more layers of filaments disposed adjacent and substantially parallel to one another. The reinforcing fiber material, that is, the reinforcement, renders the coating less susceptible to cracking and to damage from foreign objects while the belt is in use on the long nip press.

With reference now to the method for manufacturing the belt of the present invention, the method includes providing a base fabric having the form of an endless loop with an inner surface and an outer surface. One then applies a coating of polymeric resin on at least one of the inner and outer surfaces of the base fabric. Specifically, the coating is applied to that surface of the base fabric which will be on the inside of the belt in its endless loop form at the conclusion of the manufacturing process. Typically, this will be the inner surface of the base fabric in endless loop form, although it may be the outer surface where the base fabric is of sufficient length to be inverted, or turned inside-out, at the conclusion of the manufacturing process.

In either case, the base fabric is coated with polymeric resin to a thickness less than the customary finished coated thickness of an long nip press belt. At that point the coating process is interrupted while the flexible layer of reinforcing fiber material is disposed on the coating of polymeric resin. The coating process is then resumed, encapsulating the flexible layer of reinforcing fiber material within the polymeric resin being used, until the desired belt thickness is reached. After the polymeric resin coating is cured, it may be ground to provide the belt with a smooth surface and a uniform thickness.

The flexible layer of reinforcing fiber material may comprise elongated filaments of plastic, that is, of a synthetic polymeric resin extruded into filament form, or of metal in the form of braided strands of fine wire. In general, the reinforcing fiber material must have a higher tensile strength than the coating material, and must be at least as flexible as that material.

The present invention will now be described in greater detail below, with frequent reference being made to the figures, which are listed and identified as follows.

DETAILED DESCRIPTION OF THE PREFERRED EMBODIMENT

Figure 1:
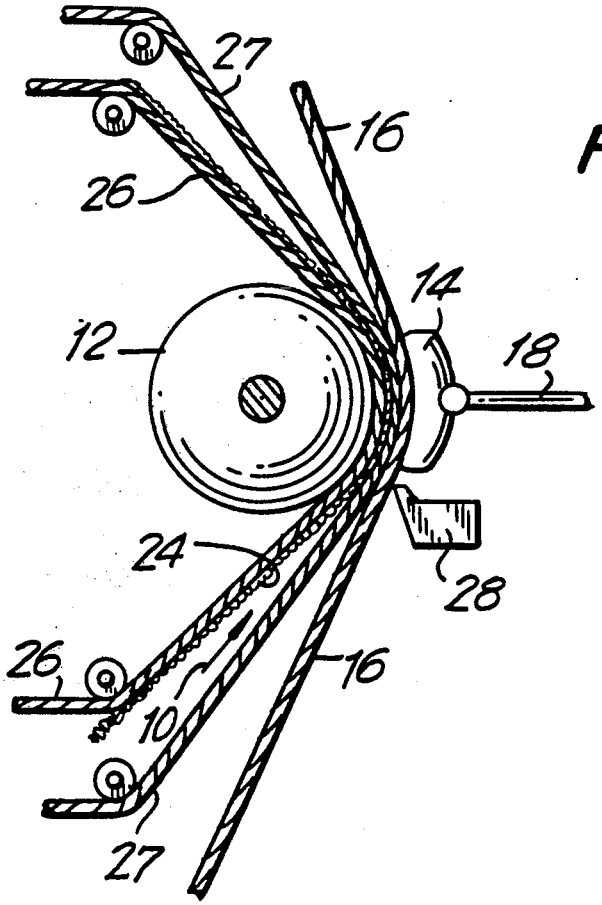
FIG. 1 is a side elevational view of a long press nip for which the belt of the present invention has been designed.
Figure 2:
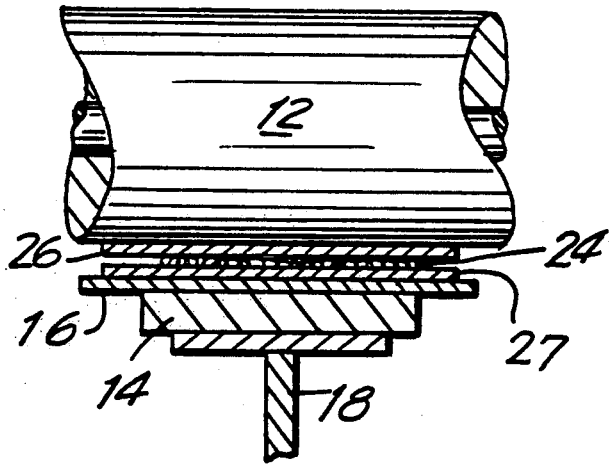
FIG. 2 is a partially sectioned front view of the press nip shown in FIG. 1.

A long nip press for dewatering a fibrous web being processed into a paper product on a paper machine is shown in FIGS. 1 and 2. The press nip 10 is defined by a smooth cylindrical press roller 12, an arcuate pressure shoe 14, and a belt 16 of the present invention arranged such that it bears against the surface of the cylindrical press roller 12. The arcuate pressure shoe 14 has about the same radius of curvature as the cylindrical press roller 12. The distance between the cylindrical press roller 12 and the arcuate pressure shoe 14 may be adjusted by means of conventional hydraulic or mechanical apparatus, which is not shown, connected to rod 18 pivotally secured to arcuate pressure shoe 14. The rod 18 may also be actuated to apply the desired pressure to the arcuate pressure shoe 14. It will be appreciated that the cylindrical press roller 12 and the arcuate pressure shoe 14 described above and shown in FIGS. 1 and 2 are conventional in the art.

As shown in FIGS. 1 and 2 are a first papermaker's wet press fabric 26, a second papermaker's web press fabric 27, and a fibrous web 24 being processing into a paper sheet. The motions of the belt 16, the fibrous web 24, the first papermaker's web press fabric 26, and the second papermaker's web press fabric 27 through the press nip 10 are upward in FIG. 1. Lubricating means 28 in FIG. 1 dispenses oil onto the side of belt 16 facing arcuate pressure shoe 14 to facilitate its sliding motion thereagainst.

Figure 3:
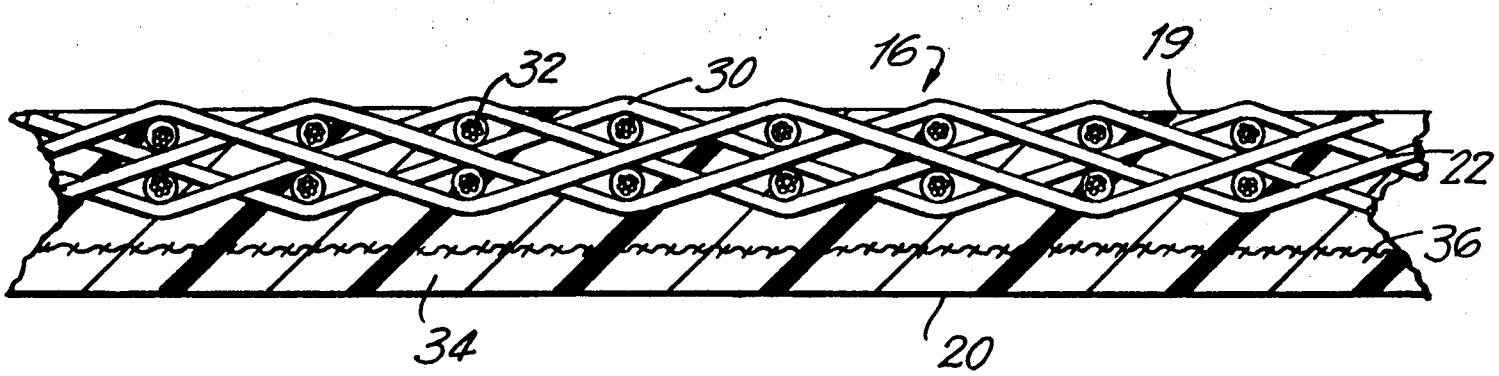
FIG. 3 is a sectional side elevational view of the belt of the present invention.

A sectional side elevational view of the belt 16 of the present invention is shown in FIG. 3. Belt 16 takes the form of an endless loop of which only a portion is shown in FIG. 3. It has an outer surface 19 an inner surface 20.

The belt 16 includes a base fabric 22 which takes the form of an endless loop. Base fabric 22 can be produced, or woven, in endless form, or can be produced in flat form, such as by flat weaving, and joined into endless form by a seam. Such seaming into endless form should preferably be done before any coating is applied to the belt.

Base fabric 22 may be woven from monofilament yarns of a synthetic polymeric resin such as polyester, polyamide, or polyethylene terephthalate (PET) in the same manner as other fabrics used in the papermaking industry are woven. Base fabric 22 includes machine-direction yarns 30 and cross-machine direction yarns 32, so-called because of the directions they assume relative to the papermachine when belt 16 has been installed thereon. The base fabric 22 may be of a single- or multi-layer weave.

Base fabric 22 is of a weave sufficiently open to permit complete impregnation thereof by the polymeric resin coating material 34. Complete impregnation eliminates the possibility of undesirable voids forming in the finished belt 16. Voids are particularly undesirable because they may allow the lubricating oil used between the belt 16 and the arcuate pressure shoe 14 to pass through the belt 16 and contaminate the press fabric, or fabrics, and fibrous web being processed into paper.

The polymeric resin coating 34 is applied to at least one surface of the base fabric 22, that surface being the one which will ultimately be the inner surface 20 of the endless loop of belt 16. As the inner surface 20 slides across the lubricated arcuate pressure shoe 14, the polymeric resin coating 34 protects the base fabric 22 from such sliding contact and the wear by abrasion that would otherwise result. The polymeric resin coating material 34 may be polyurethane, and is preferably a 100% solid composition to avoid the formation of bubbles during the curing process, through which the polymeric resin coating material 34 proceeds following its application upon the base fabric 22.

A polymeric resin coating 34 such a this undergoes considerable punishment during the operation of the belt 16 on a papermachine. Cracking of the polymeric resin coating 34 may follow from the repeated flexing of the belt 16 as it passes through the press nip 10 and around the machine components which guide and control its motion. Damage to the polymeric resin coating 34 may also be caused by contact with foreign objects while the belt 16 is in use on the papermachine. In the present invention, the polymeric resin coating 34 is reinforced to protect it from cracking and other damage, both of which may considerably shorten the useful life of the belt on the papermachine.

The polymeric resin coating 34 is reinforced by encapsulating therewithin a flexible layer of reinforcing fiber material. In the embodiment shown in FIG. 3, the flexible layer 36 is a sheet woven from filaments of reinforcing fiber material. The filaments themselves may be monofilaments of a synthetic polymeric resin such as polyester, polyamide, or polyethylene terephthalate (PET), and are preferably finer than the monofilaments used in the weaving of base fabric 22. In general, the reinforcing fiber material must have a higher tensile strength than the polymeric resin coating material 34, and must be at least as flexible as that material.

Figure 5:
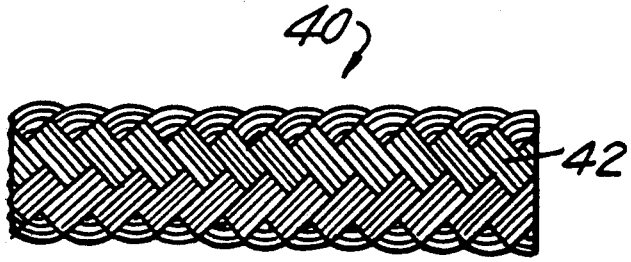
FIG. 5 is a plan view of a braided strand of fine metal wire finding application in an embodiment of the present invention.
Figure 4:
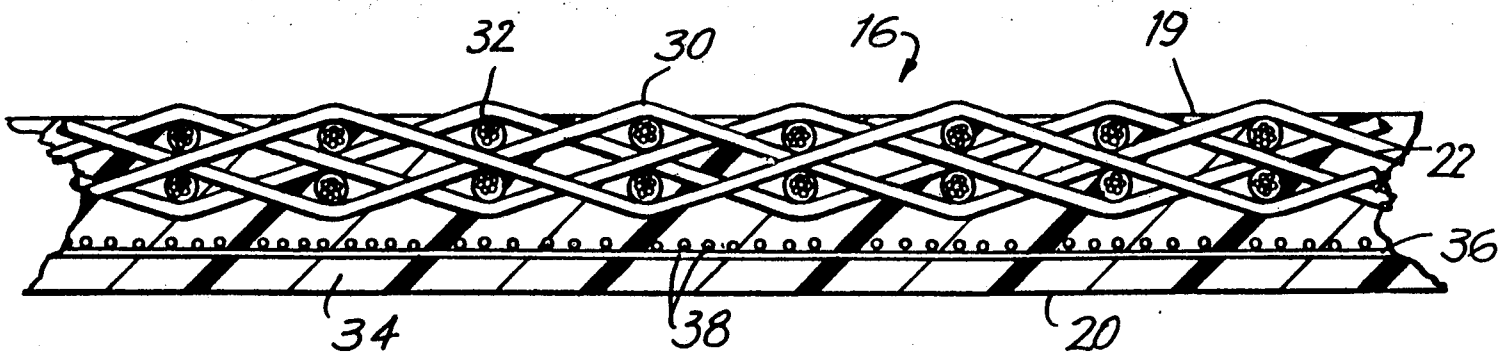
FIG. 4 is a sectional side elevational view of an alternate embodiment of the belt of the present invention.

In a alternate embodiment of belt 16 of the present invention shown in a sectional side elevational view in FIG. 4, where elements identical to those of the embodiment shown in FIG. 3 are identified with the same reference numerals, the flexible layer 36 of reinforcing fiber materials comprises two layers of elongated filaments 38, one of said layers being in the machine-direction, the other in the cross-machine direction. In each layer, the elongated filaments 38 are disposed adjacent and substantially parallel to one another. The flexible layer 36 of reinforcing fiber material may alternatively comprise one layer of elongated filaments 38 or more than two layers of such filaments. For example, the flexible layer 36 of reinforcing fiber material may comprise one layer of elongated filaments 38, wherein the elongated filaments 38 comprise braided strands of fine metal wire wound spirally around the belt 16 substantially in the machine direction within the polymeric resin coating material 34. Such a braided strand 40 of fine metal wire 42 is shown in FIG. 5. As can be seen in FIGS. 3 and 4, the flexible layer 36 is separate from and spaced from the base fabric 22.

The belts 16 of the present invention are manufactured according to technology known in the art by providing a base fabric 22 of the variety described above, and by applying a polymeric resin coating 34 on at least one surface of base fabric 22 to a thickness less than the final thickness desired for the finished belt 16. At that point, the coating process is interrupted, and the flexible layer 36 of reinforcing fiber material is applied to the partially coated base fabric 22. Because the polymeric resin coating 34 is at this point not cured, the flexible layer 36 of reinforcing fiber material may readily adhere thereto. Then, the coating process is resumed, thereby encapsulating the flexible layer 36 within the polymeric resin coating 34 and providing the belt 16 with its final desired thickness. The polymeric resin coating 34 is then cured, and the cured polymeric resin coating 34 is ground to provide the belt 16 with a smooth surface and uniform thickness.

It should be clear that modifications to the above would be obvious to anyone skilled in the art without departing from the scope of the claims appended hereto.

What is claimed is:

1. A belt on a long nip press for dewatering a fibrous web, said long nip press having a cylindrical press roller and an arcuate pressure shoe which together define a nip therebetween, said belt being passed through said nip in conjunction with at least one press fabric supporting and carrying said fibrous web to be dewatered between said press fabric and said arcuate pressure shoe, said belt therefore having a shoe side and a fabric side, said belt comprising:

a base fabric in the form of an endless loop having an inner surface and outer surface, said inner surface being on said shoe side of said belt and said outer surface being on said fabric side of said belt, said base fabric having machine-direction and cross-machine direction yarns and being a fabric woven therefrom, said machine-direction being around said loop and said cross-machine direction being across said loop; and a coating of a polymeric resin on at lest said inner surface of said base fabric, said coating impregnating and rendering said base fabric impervious to liquids, said coating being smooth and providing said belt with a uniform thickness, said coating further being reinforced with a flexible layer of reinforcing fiber material separate from and spaced from said base fabric, said reinforcing fiber material including elongated filaments finer than said machine-direction and cross-machine direction yarns of said base fabric and said flexible layer of reinforcing fiber material being encapsulated within said coating, so that said coating may be less susceptible to cracking and to damage from foreign objects while said belt is in use on said long nip press.

2. A belt on a long nip press as claimed in claim 1 wherein said polymeric resin is polyurethane.

3. A belt on a long nip press as claimed in claim 1 wherein said base fabric is a multi-layer fabric.

4. A belt on a long nip press as claimed in claim 1 wherein said machine-direction and cross-machine direction yarns are monofilaments of a synthetic polymeric resin selected from the group consisting of polyester and polyamide resins.

5. A belt on a long nip press as claimed in claim 1 wherein said flexible layer of reinforcing fiber material is a sheet woven from said elongated filaments.

6. A belt on a long nip press as claimed in claim 1 wherein said flexible layer of reinforcing fiber material is a single layer of said elongated filaments disposed adjacent and substantially parallel to one another.

7. A belt on a long nip press as claimed in claim 1 wherein said flexible layer of reinforcing fiber material includes more than one layer of said elongated filaments, said elongated filaments in each of said layers being disposed adjacent and substantially parallel to one another.

8. A belt on a long nip press as claimed in claim 1 wherein said elongated filaments of said flexible layer of said reinforcing fiber material are monofilaments of a synthetic polymer resin selected from the group consisting of polyester and polyamide resins.

9. A belt on a long nip press as claimed in claim 1 wherein said elongated fibers of said flexible layer of said reinforcing fiber material are braided strands of fine metal wire.

* * * * *